US005774983A

United States Patent [19]

Maejima

[11] Patent Number: 5,774,983

[45] Date of Patent: Jul. 7, 1998

[54] METHOD OF INSERTING TERMINALS INTO HOUSING WITH SPECIAL ARRANGEMENT

[75] Inventor: Takamichi Maejima, Haibara-gun, Japan

[73] Assignee: Yazaki Corporation, Tokyo, Japan

[21] Appl. No.: 745,612

[22] Filed: Nov. 8, 1996

[30] Foreign Application Priority Data

Nov. 10, 1995 [JP] Japan ..... 7-292803

[51] Int. Cl.[6] ..... H01R 43/20; H01R 9/16

[52] U.S. Cl. ..... 29/881; 29/33 M; 29/748; 29/759

[58] Field of Search ..... 29/33 M, 759, 29/748, 837, 845, 881

[56] References Cited

U.S. PATENT DOCUMENTS 4,967,470 11/1990 Folk ..... 29/748 X
5,414,925 5/1995 Nishide et al. ..... 29/748
5,459,924 10/1995 Ohsumi et al. ..... 29/881
5,515,601 5/1996 Maejima ..... 29/33 M X
5,657,535 8/1997 Maejima ..... 29/748 X

FOREIGN PATENT DOCUMENTS 7-114969 5/1995 Japan .

*Primary Examiner*—Peter Vo
*Attorney, Agent, or Firm*—Armstrong, Westerman, Hattori, McLeland & Naughton

[57] ABSTRACT

A terminal is inserted randomly into a specially arranged housing with terminal receiving chambers arranged in staggered fashion, the terminal inserting method to a specially arranged housing 2 in which it allows leading electric wires 9 from the specially arranged housing 2 where terminal receiving chambers are arranged in the staggered fashion to push aside by a guide claw 3, wherein the guide claw 3 is entered along the bulkheads 5, 6 extending rectilinearly between columns of the terminal receiving chambers $\mathbf{1}_1$, $\mathbf{1}_2$, $\mathbf{1}_3$ of the specially arranged housing 2. An entering direction of the guide claw 3 is harmonized with the extending direction of the rectilinear bulkheads 5, 6 by 90°-turn-over of the specially arranged housing 2.

4 Claims, 9 Drawing Sheets

METHOD OF INSERTING TERMINALS INTO HOUSING WITH SPECIAL ARRANGEMENT

BACKGROUND OF THE INVENTION

1. Field of the Invention

The present invention relates to a method of inserting terminals into a housing with a special arrangement in which the method makes it possible for the electric wire, in the specially arranged housing having terminal receiving chambers are arranged in staggered fashion, to be pushed aside and allows random insertion of the terminals.

2. Description of the Prior Art

FIGS. 7 and 8 show a conventional inserting method for a terminal which has been proposed in Japanese Patent Application Laid Open No. Hei 7-114969 by the applicant of the present application.

In the conventional inserting method for the terminal, a connector housing 2 is fixed in such a way that the connector housing 2 is placed in a lateral direction. Electric wires 9 with terminals are grabbed by a pair of grabbing claws 11, 12 in front of and behind the terminal inserting head. The terminals are inserted into the terminal receiving chamber 1 of the connector housing 2. A pair of guide claws 3*a*, 3*b* are integrally fluctuated with the grabbing claws 11, 12. An opening of the required terminal receiving chamber 1' is conserved due to pushing the derived electric wires 9 (already inserted into the electric wire 9 with terminal) aside by the pair of guide claws 3*a*, 3*b*. In this condition, the next terminal 10 is inserted by the grabbing claws 11, 12.

The pushing-aside operation by the guide claw 3 makes it possible for the terminal 10 to implement the random insertion to the required terminal receiving chamber 1'. In FIG. 8, reference numerals 10, 9 show the terminal and the electric wire, respectively to be inserted from this time forth.

However, as shown in FIGS. 8 and 9, when the specially arranged housing, having terminal receiving chambers arranged in staggered fashion, is used, as shown in FIGS. 11, 12, this introduces the derived risk of injury to the electric wire 9'. If pushing the electric wire 9 aside allows the guide claw 3 to descend along the partition wall (side wall) of the required terminal receiving chamber 1' (the terminal 10 beginning to be inserted), the pointed end 7 of the guide claw 3 impinges on the derived electric wire 9' from the terminal receiving chamber 1" located downwardly of the partition wall 8. Thus, there is the derived risk of injury to the electric wire 9'.

Consequently, for the specially arranged housing, the terminal 10 is forced to be inserted by hand. This is the main cause of obstructing the manufacture when it allows the wire-harness to manufacture automatically. As shown in FIG. 9, the specially arranged housing 2 has terminal receiving chambers $1_1$, $1_2$, $1_3$ which are arranged in three columns of left, middle, and right. The partition walls 8 (side walls) of each of the left-column of the terminal receiving chamber $1_1$ or right-column of the terminal receiving chamber $1_3$ are positioned at the center line of the terminal receiving chambers $1_2$ of the middle-column so as to form rows that are staggered in the height or Z-direction of the specially arranged housing 2.

SUMMARY OF THE INVENTION

In view of the foregoing, it is an object of the present invention to provide a terminal inserting method in which the terminal is capable of being inserted randomly into the desired terminal receiving chamber by carrying out by steps including pushing aside the electric wires which are inserted into the specially arranged connector housing having terminal receiving chambers which are arranged in the columns and staggered rows, by means of a guide claw.

According to one aspect of the present invention, for achieving the above-mentioned object, a method is provided for inserting a terminal into a specially arranged housing to form derived electric wires extending outwardly from the specially arranged housing where terminal receiving chambers are arranged in columns and staggered rows. A guide claw is used to push the derived electric wires aside, by the moving the guide claw entered along side of a bulkhead extending rectilinearly between columns of the terminal receiving chambers of the specially arranged housing.

The downward direction, in which the guide claw moves is capable of being harmonized with the extending direction of the rectilinear bulkhead by turning the specially arranged housing through an angle of 90° degrees.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

Preferred embodiments of the invention will now be described in detail referring to the accompanying drawings.

Figure 1:
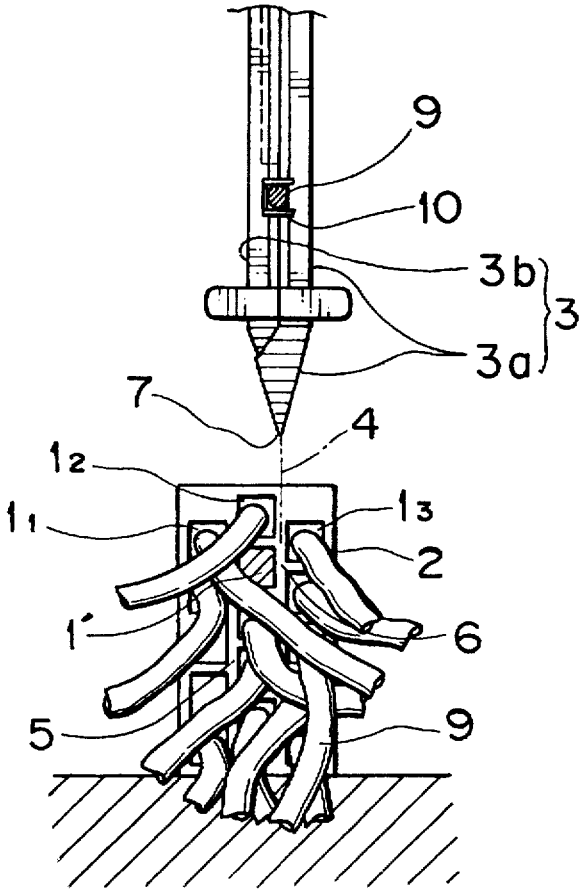
FIG. 1 is an elevational view showing one example of a method of inserting terminals into a specially arranged housing according to the present invention.
Figure 2:
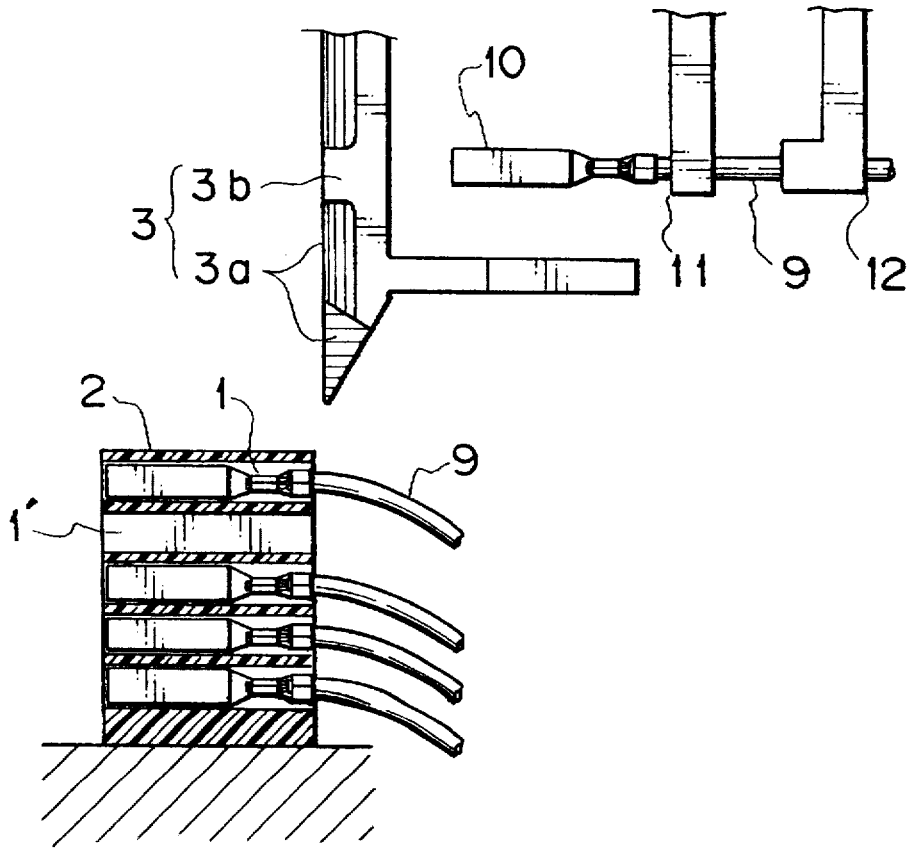
FIG. 2 is a side view showing a guide claw and a holding claw with respect to a vertical cross-section of the connector housing.
Figure 3:
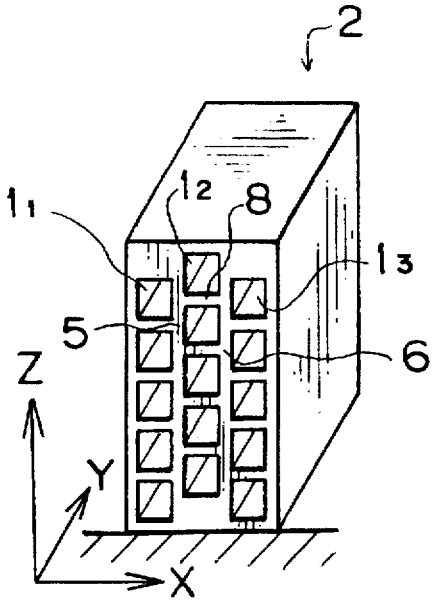
FIG. 3 is a perspective view showing a condition where the specially arranged housing is placed longitudinally.

FIGS. 1 to 3 show a method of inserting terminals into a specially arranged housing according to the present invention.

In this inserting method for the terminal, the specially arranged housing 2 whose terminal receiving chambers 1 are arranged in columns and staggered rows, is placed longitudinally, so that an approach path 4, for a guide claw 3 which is used for pushing the electric wires aside, is conserved on the partition walls or bulkheads 5, 6 in the perpendicular direction thereof between the left side terminal receiving chamber $1_1$ and the right side terminal receiving chamber $1_2$, or between the middle terminal receiving chamber $1_2$ and the right side terminal receiving chamber $1_3$, so that the pointed end 7 of the guide claw 3 does not pass over or obstruct the opening of the terminal receiving chamber 1.

Figure 4:
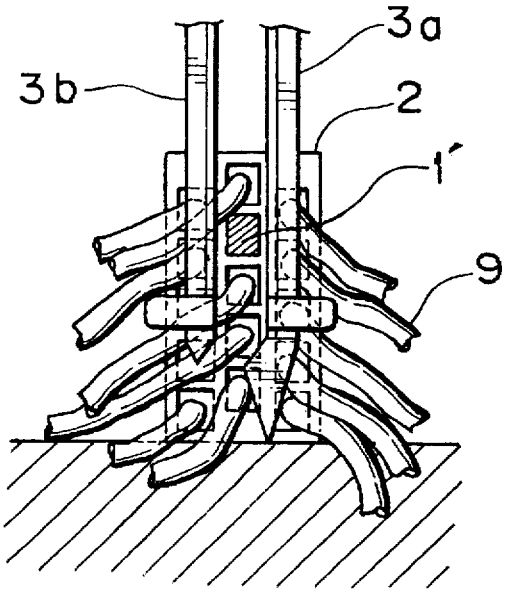
FIG. 4 is an elevational view showing a condition where the electric wires leading from the connector housing are pushed aside by the guide claw.
Figure 9:
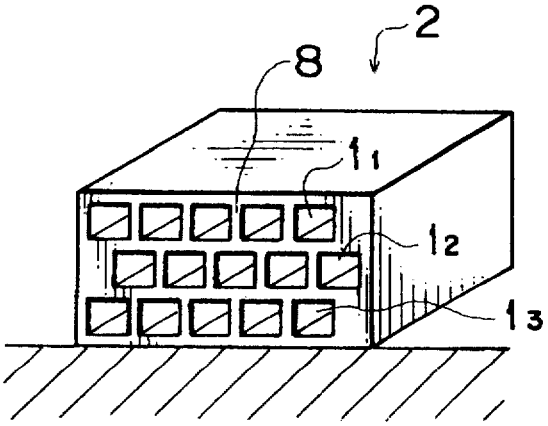
FIG. 9 PRIOR ART
FIG. 9 is a perspective view showing a condition where the specially arranged housing is placed laterally.
Figure 10:
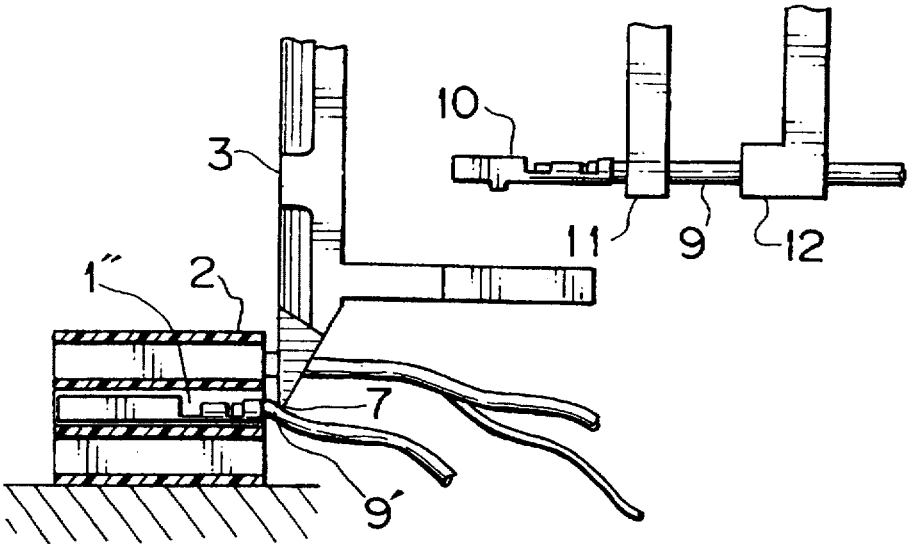
FIG. 10 PRIOR ART
FIG. 10 is a side view showing the conventional problems.
Figure 11:
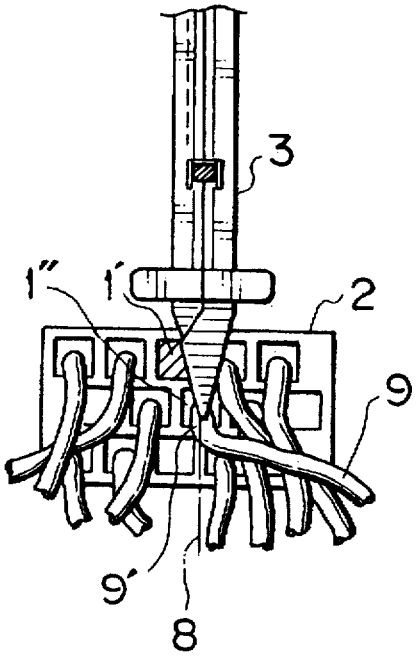
FIG. 11 PRIOR ART
FIG. 11 is an elevational view of FIG. 10.

The specially arranged housing 2 is equivalent to the housing as shown in FIG. 9 of the conventional example. The specially arranged housing 2 is placed longitudinally as shown in FIG. 3. The partition wall 8 in the lateral direction thereof of the terminal receiving chamber $1_2$ of the middle column is positioned on a line which joins the centers of the terminal receiving chambers $1_1$, $1_3$ in the left side column and right side column, respectively. The bulkhead 5 lies between the left side terminal receiving chamber $1_1$ and the middle terminal receiving chamber $1_2$. The bulkhead 6 lies between the right side terminal receiving chamber $1_3$ and the middle terminal receiving chamber $1_2$. Since the bulkheads 5 and 6 extend rectilinearly in the vertical direction, as shown in FIG. 1, the closed guide claw 3 is capable of being moved downwardly among the derived electric wires 9 along the bulkheads 5 and 6 extending in the vertical direction. Then, as shown in FIG. 4, the derived electric wires 9 are pushed aside from left to right which is caused by the downward movement of the pair of guide claws 3*a* and 3*b*, so that the opening of the desired terminal receiving chamber 1' is not obstructed.

In the embodiment as shown in FIGS. 1 and 2, the terminal 10 is inserted horizontally into the terminal receiving chamber 1 of the guide claw 3 when the connector housing 2 is in its upright or longitudinal orientation. However, the connector housing 2, can be oriented as shown in FIG. 9 so that its right side (as shown in FIG. 3) is laying on a surface parallel to the X-direction (i.e., −90 degrees). For example, the terminal 10 may be inserted into the left side terminal receiving chamber $1_1$, when the connector housing has been laid on its right side and the terminal 10 may be inserted into the right side terminal receiving chamber $1_3$ when the connector housing 2 is laid on its left side. Further, even if the connector housing is placed laterally as shown in FIG. 9, and the connector housing has an arrangement of the receiving chambers $1_1$, $1_2$, $1_3$ which is similar to FIG. 3, it is not necessary to turn the connector housing 2 by 90 degrees. The connector housing can be used as it is shown in FIG. 9 being placed laterally.

Figure 5:
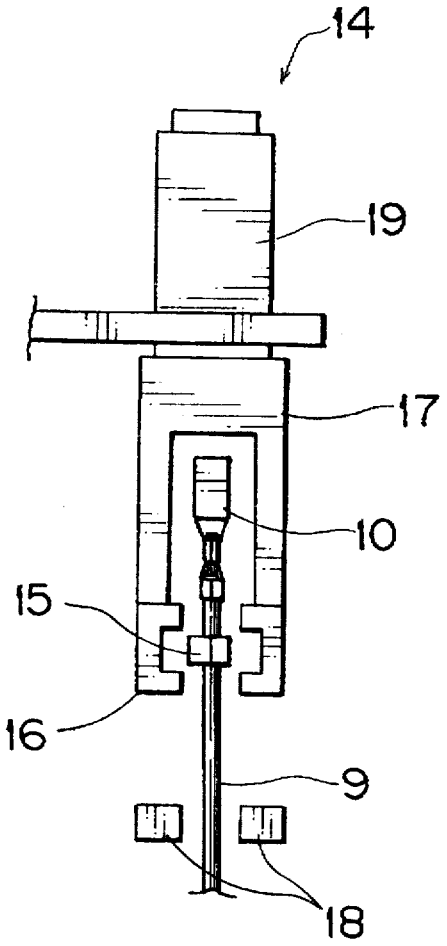
FIG. 5 is a plan view showing an outline of a terminal turn-over apparatus.

The turning of the terminal 10 by 90 degrees is executed by using the turn-over apparatus 14 as shown in FIG. 5, prior to derived process where the electric wires 9 extending from the inserted terminals are grabbed by the grabbing claws 11, 12. The apparatus 14 is the same type as the apparatus which is proposed by the applicant in Japanese Patent Application Laid-Open No. Hei 7-142144. The turn-over apparatus 14 comprises a chuck claw 16 for receiving the derived electric wires 9 extending from the inserted terminals grabbed by the clip 15, a chuck cylinder 17 for opening and closing the chuck claw 16, a hand 18 for grabbing the derived electric wires 9 at the rear of chuck claw 16, and a positioning motor 19 for revolving the chuck claw 16 together with the cylinder 17 to the required angle. The derived electric wires 9 are twisted by the revolving of the chuck claw 16 in the grabbed condition so that the terminal 10 is turned by 90 degrees.

The grabbing claws 11 and 12 of a terminal inserting head 21 (referring to FIG. 6) can receive the twisted derived electric wires 9, extending from the derived terminal, from the inserted chuck claw 16. As shown in FIG. 2, the pointed end of the terminal has been inserted into the connector housing 2 through the guide claw 3 during the grabbing of the derived electric wires 9 by the grabbing claws 11 and 12 on both sides, before the entire terminal 10 is inserted by only the rear side grabbing claw 12.

Figure 6:
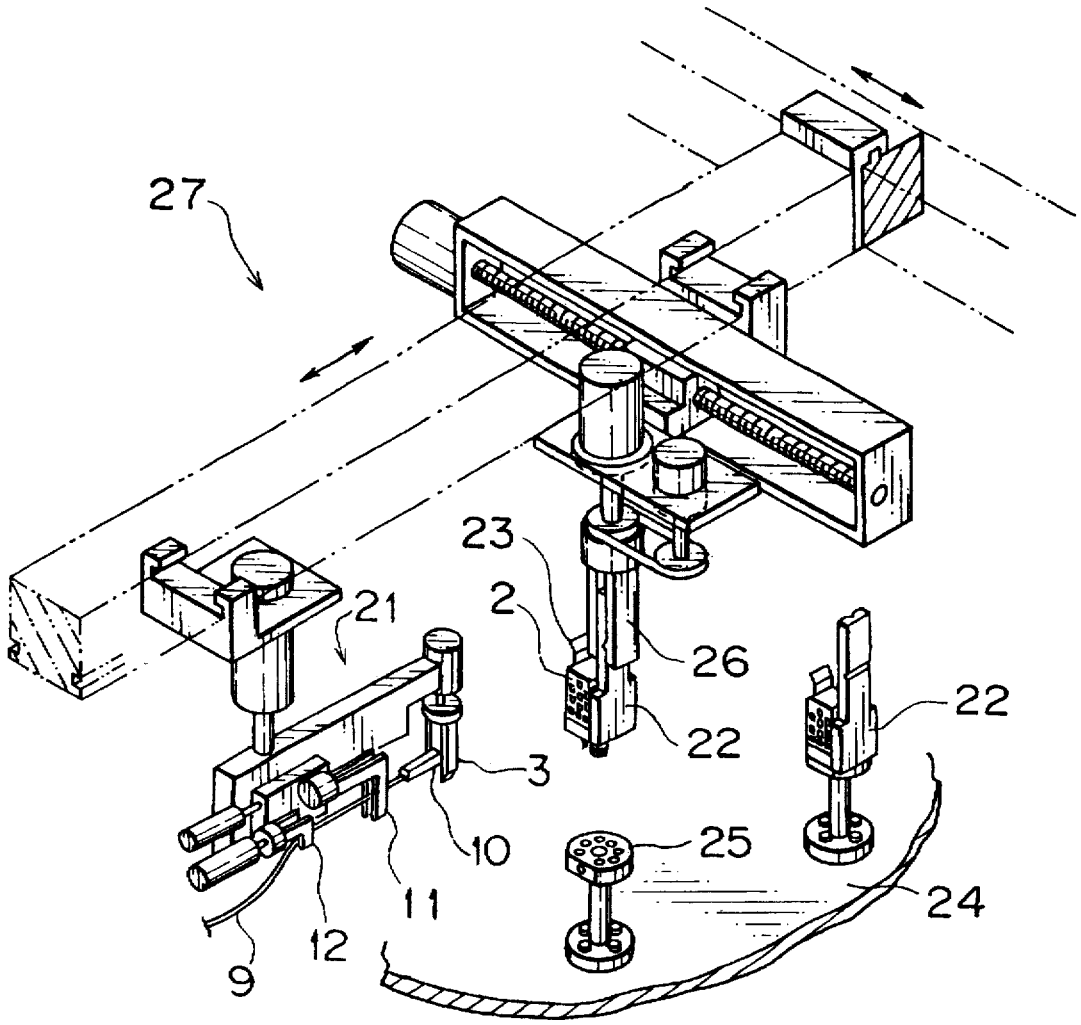
FIG. 6 is a perspective view showing a terminal inserting apparatus including receiving member which holds the specially arranged housing.
Figure 7:
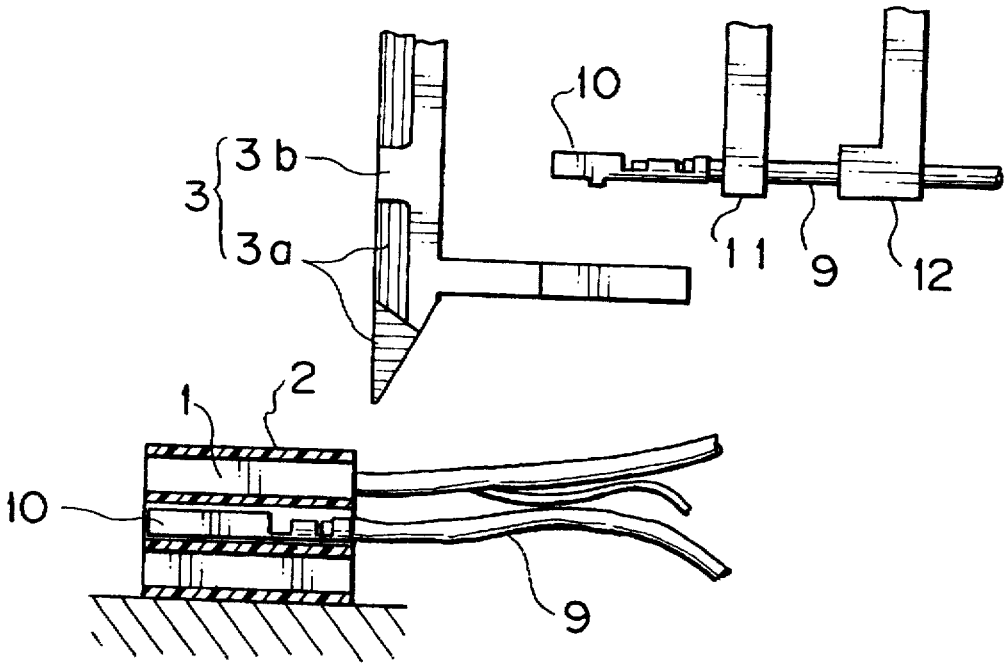
FIG. 7 PRIOR ART
FIG. 7 is a side view showing a conventional terminal inserting method.
Figure 8:
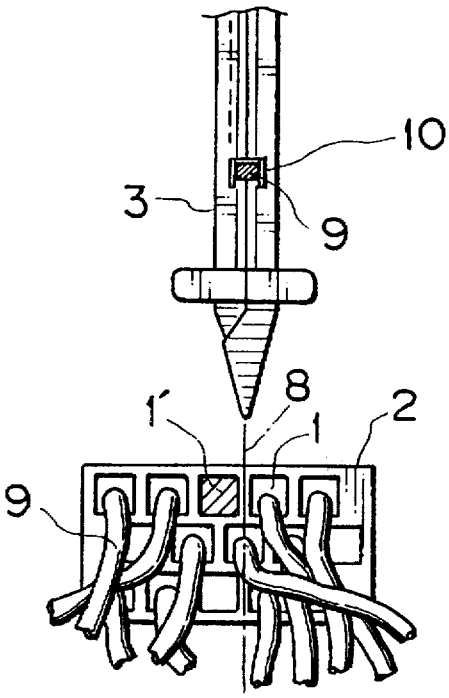
FIG. 8 PRIOR ART
FIG. 8 is an elevational view of FIG. 7.

FIG. 6 shows an automatic terminal inserting apparatus as one example of a holding method for the connector housing 2. The connector housing 2 is pressed to be held to an L-shaped connector receiving member 22 in the longitudinally placed condition by a spring piece 23. The receiving member 22 is removed from the base member 25 on the pallet 24 by the chuck section 26 which can shift freely in the three-dimensional direction. In this condition, the terminal 10 is inserted into the connector housing 2 on the receiving member 22 by the terminal inserting head 21. The apparatus 27 has been proposed in the Japanese Patent Application No. Hei 7-203344.

As stated above, according to the present invention, since the pointed end of the guide claw, for pushing aside the electric wires, is capable of being moved downwardly among the electric wires and along the bulkhead extending rectilinearly between the terminal receiving chambers of the connector housing, the pointed end of the guide claw does not impinge on the electric wires so that the electric wires are not damaged. For this reasons, even with the specially arranged housing in which the terminal receiving chambers are arranged in columns and staggered rows, the electric wires are capable of being pushed aside, so that the terminals can be inserted randomly into the desired terminal receiving chamber. Consequently, even when the specially arranged housing is used, the terminal insertion is capable of being automated.

While preferred embodiments of the invention have been described using specific terms, such description is for illustrative purpose only, and it is to be understood that changes and variations may be made without departing from the spirit or scope of the following claims.

What is claimed is:

1. A method of inserting terminals into a specially arranged housing, said method comprising the steps of:

providing a specially arranged housing having terminal receiving chambers into which said terminals are to be inserted, wherein said terminal receiving chambers of said specially arranged housing are arranged in columns and in staggered rows such that a longitudinal axis of adjacent rows are at different elevations in order to allow electric wires connected to an end of said terminals and extending outwardly from said terminal receiving chambers of said specially arranged housing to be pushed aside by means of a guide claw so as to prevent interference with an insertion of subsequent electric wires;

guiding one of said terminals and an associated electric wire held in said guide claw along a bulkhead extending rectilinearly between columns of said terminal receiving chambers of said specially arranged housing; and inserting said terminals into said terminal receiving chambers of said specially arranged housing.

2. The method of inserting terminals into a specially arranged housing according to claim 1, wherein a direction of guiding said guide claw is in accordance with an extending direction of said bulkhead by setting said bulkhead vertically by turning said specially arranged housing by an angle of 90 degrees.

3. The method of inserting terminals into a specially arranged housing according to claim 2, wherein a pointed end of a terminal is inserted in a first step into said terminal receiving chamber through a hole on said guide claw and an entire terminal is inserted into said terminal receiving chamber in a secondary step.

4. The method of inserting terminals into a specially arranged housing according to claim 1, wherein a pointed end of a terminal is inserted in a first step into said terminal receiving chamber through a hole on said guide claw and an entire terminal is inserted into said terminal receiving chamber in a secondary step.

* * * * *